US012378859B2

(12) United States Patent
Batarseh

(10) Patent No.: US 12,378,859 B2
(45) Date of Patent: Aug. 5, 2025

(54) MOBILIZING HEAVY OIL

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/963,795

(22) Filed: Oct. 11, 2022

(65) Prior Publication Data

US 2024/0117723 A1 Apr. 11, 2024

(51) Int. Cl.

| | |
|---|---|
| ***E21B 43/24*** | (2006.01) |
| ***E21B 23/01*** | (2006.01) |
| ***E21B 36/04*** | (2006.01) |
| *E21B 43/14* | (2006.01) |

(52) U.S. Cl.

CPC ..... *E21B 43/2401* (2013.01); *E21B 23/01* (2013.01); *E21B 43/14* (2013.01); *E21B 43/2405* (2013.01)

(58) Field of Classification Search

CPC ..... E21B 43/2401

See application file for complete search history.

(56) References Cited

U.S. PATENT DOCUMENTS

| | | | |
|---|---|---|---|
| 9,322,257 | B2 | 4/2016 | Parsche |
| 9,719,337 | B2 | 8/2017 | Menard et al. |
| 10,107,932 | B2 | 10/2018 | Mishkhes et al. |
| 10,494,909 | B2 | 12/2019 | Grounds, III et al. |
| 11,187,068 | B2 | 11/2021 | Batarseh |
| 2011/0036576 | A1* | 2/2011 | Schultz et al. |

(Continued)

FOREIGN PATENT DOCUMENTS

| | | |
|---|---|---|
| AU | 2011205183 | 8/2011 |
| CA | 2089800 | 2/1998 |

(Continued)

OTHER PUBLICATIONS

International Search Report and Written Opinion in International Appln. No. PCT/US2023/076096, mailed on Feb. 12, 2024, 16 pages.

*Primary Examiner* — Tara Schimpf
*Assistant Examiner* — Ursula Lee Norris
(74) *Attorney, Agent, or Firm* — Fish & Richardson P.C.

(57) ABSTRACT

A system for producing hydrocarbons from a subsurface formation includes a main wellbore, a first lateral extending off the main wellbore, the first lateral configured to produce hydrocarbons from the subsurface formation to a ground surface through the main wellbore, a second lateral extending off the main wellbore, tubing extending down the main wellbore into the second lateral, and a tool attached to the tubing. The tool includes a support structure with a longitudinal axis and having a cylindrical shape, the support structure including one or more latching mechanisms, expandable packers mechanically coupled to the support structure, the expandable packers being radially expandable to secure the tool within the second lateral, an electromagnetic source mechanically coupled to the support structure and operable to generate electromagnetic radiation, and an antenna communicatively coupled to the electromagnetic source and operable to transmit the electromagnetic radiation, the antenna being at least partially disposed within the expandable casing.

4 Claims, 7 Drawing Sheets

(56) References Cited

U.S. PATENT DOCUMENTS

| | | | |
|---|---|---|---|
| 2012/0012319 | A1 | 1/2012 | Dennis |
| 2013/0213637 | A1 | 8/2013 | Kearl |
| 2016/0177685 | A1 | 6/2016 | Frederick et al. |
| 2018/0266226 | A1* | 9/2018 | Batarseh et al. |
| 2019/0249529 | A1 | 8/2019 | Wright et al. |
| 2020/0088019 | A1* | 3/2020 | Batarseh et al. |
| 2020/0248543 | A1* | 8/2020 | Batarseh |

FOREIGN PATENT DOCUMENTS

| | | | | |
|---|---|---|---|---|
| CA | 2723198 | | | 2/2016 |
| CA | 2829145 | | | 3/2017 |
| CA | 2961312 | C | * | 9/2018 |
| CA | 2892754 | | | 3/2020 |
| CA | 2943134 | | | 3/2022 |
| CN | 109667570 | | | 4/2019 |
| CN | 110778298 | | | 2/2020 |
| WO | WO 2020159986 | | | 8/2020 |

* cited by examiner

MOBILIZING HEAVY OIL

TECHNICAL FIELD

This disclosure generally relates to enhanced oil recovery in particular using directed microwave and radio frequency radiation with dual well systems.

BACKGROUND

Producing heavy oil, such as oil with a viscosity over 5000 cP, can be difficult. In some cases, reducing the viscosity of the oil mobilizes the oil and increases the rate of oil recovery from formations with heavy oil. Steam injection is a common method for heavy oil mobilization.

SUMMARY

This specification describes systems and methods for mobilizing heavy oil using directed microwave and radio frequency waves to heat the heavy oil and reduce the viscosity of the heavy oil. For example, microwave and radio frequency waves can be used to stimulate wells to allow natural gas, petroleum, and brine to flow more freely. Using electromagnetic waves can be advantageous because it can reduce heat loss, reduce the surface footprint of the machinery, and reduce the use of water (e.g., to make steam for stimulating wells). A dual well can be used to produce oil more effectively, e.g., by increasing reservoir contact and targeting the desired oil zones, which can save energy. An example of a dual well is a well with at least two laterals, (a first used to produce oil from the formation and a second receiving a downhole tool to mobilize the heavy oil, e.g., by directing microwave and radio frequency waves at the oil).

In an aspect, a system for producing hydrocarbons from a subsurface formation includes a main wellbore, a first lateral extending off the main wellbore, the first lateral configured to produce hydrocarbons from the subsurface formation to a ground surface through the main wellbore, a second lateral extending off the main wellbore, tubing extending down the main wellbore into the second lateral, and a tool attached to the tubing, the tool including a support structure with a longitudinal axis and having a cylindrical shape, the support structure including one or more latching mechanisms, expandable packers mechanically coupled to the support structure, the expandable packers being radially expandable to secure the tool within the second lateral, an electromagnetic source mechanically coupled to the support structure and operable to generate electromagnetic radiation, and an antenna communicatively coupled to the electromagnetic source and operable to transmit the electromagnetic radiation, the antenna being at least partially disposed within the expandable casing.

In some implementations, the first lateral is located further from the surface than the second lateral.

In some implementations, the tubing comprises multiple first laterals.

In some implementations, the multiple first laterals are each located further from the surface than the second lateral.

In some implementations, at least one of the first laterals is located closer to the surface than the second lateral.

In some implementations, the electromagnetic source generates electromagnetic radiation having frequencies in the microwave region of the electromagnetic spectrum.

In some implementations, the antenna is mechanically rotatable about the longitudinal axis of the support structure.

In some implementations, the antenna is capable of electronically steering the electromagnetic radiation.

In some implementations, the tool is attached to the tubing such that hardware for the tool can be stored within the tubing.

In an aspect, tool for transmitting electromagnetic radiation within a wellbore in a hydrocarbon formation includes a support structure with a longitudinal axis and having a cylindrical shape, the support structure including one or more latching mechanisms, expandable packers mechanically coupled to the support structure, the expandable packers being radially expandable to secure the tool within a lateral of the wellbore, an electromagnetic source mechanically coupled to the support structure and operable to generate electromagnetic radiation, and an antenna communicatively coupled to the electromagnetic source and operable to transmit the electromagnetic radiation, the antenna being at least partially disposed within the expandable casing and rotatable to steer the electromagnetic radiation.

In some implementations, the electromagnetic source generates electromagnetic radiation having frequencies in the microwave region of the electromagnetic spectrum.

In some implementations, the antenna is mechanically rotatable about the longitudinal axis of the support structure.

In some implementations, the antenna is capable of electronically steering the electromagnetic radiation.

Advantageously, this disclosure describes methods and systems for stimulating wells in hydrocarbon formations. Using electromagnetic waves to simulate the wells can be advantageous because it can reduce heat loss, the surface footprint of the required machinery, and the amount of water used (e.g., to make steam for stimulating wells). A dual well can be used to produce oil more effectivity, e.g., by increasing reservoir contact and targeting the desired oil zones.

This disclosure describes methods and systems for stimulating wells in hydrocarbon formations. The disclosure is presented to enable any person skilled in the art to make and use the disclosed subject matter in the context of one or more particular implementations. Various modifications to the disclosed implementations will be readily apparent to those skilled in the art, and the general principles defined in this application may be applied to other implementations and applications without departing from scope of the disclosure. Thus, the present disclosure is not intended to be limited to the described or illustrated implementations, but is to be accorded the widest scope consistent with the principles and features disclosed in this application.

The details of one or more embodiments of these systems and methods are set forth in the accompanying drawings and description below. Other features, objects, and advantages of these systems and methods will be apparent from the description, drawings, and claims.

DETAILED DESCRIPTION

Figure 1:
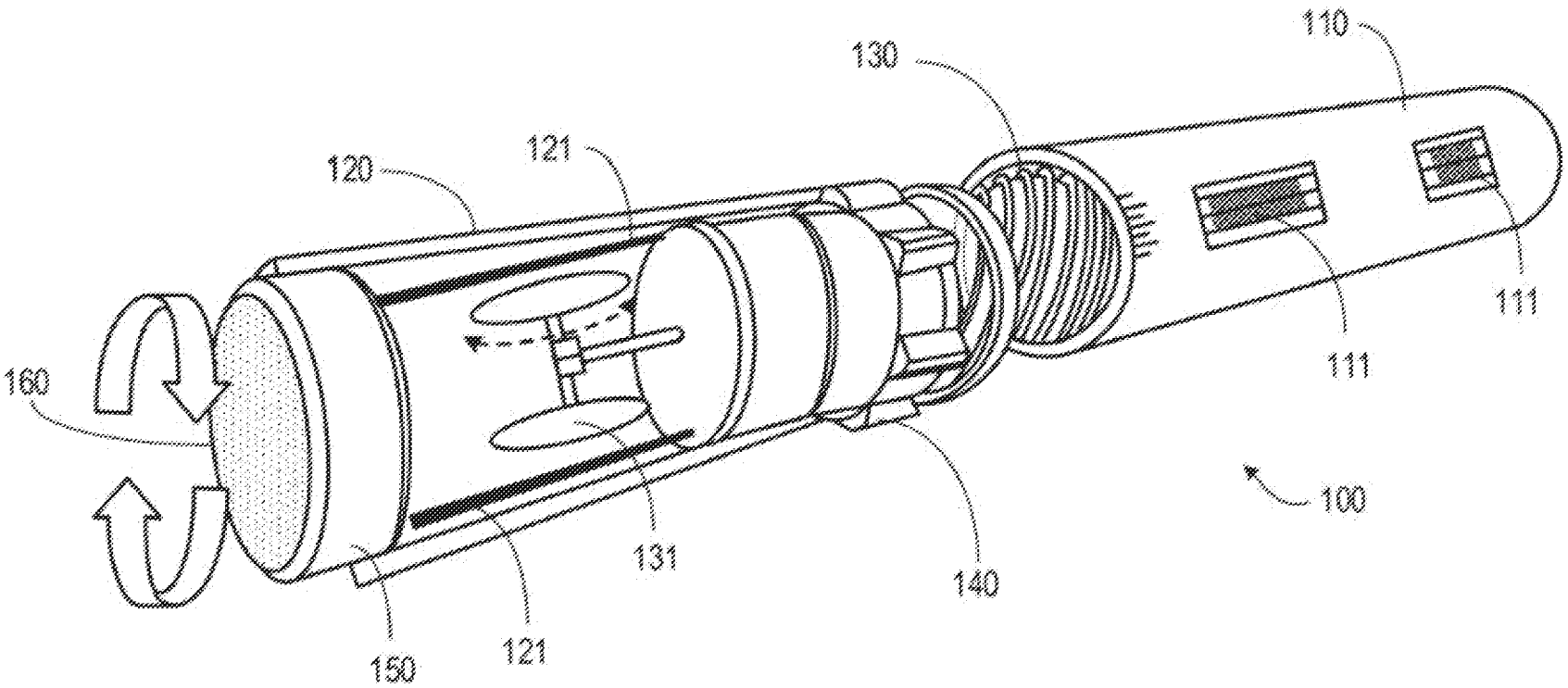
FIG. 1 is a perspective view of a downhole tool having a rotatable antenna to direct electromagnetic waves.

FIG. 1 is perspective view of a downhole tool 100 having a ceramic casing. The downhole tool 100 includes a support structure 110, a casing 120, an electromagnetic source 130, a directional antenna 131, a centralizer 140, a motor 150, and a reinforced plug 160. The support structure 110 includes latches 111. In some implementations, the downhole tool 100 includes multiple directional antenna 131.

The support structure 110 has a cylindrical shape having a longitudinal axis and is sized for placement within a wellbore. In some embodiments, the support structure 110 includes steel. Additionally, or alternatively, the support structure 110 can include other materials suitable for placement within a wellbore. In some embodiments, the support structure 110 includes vulcanized rubber (such as Ebonite), super alloys, titanium, aluminum, acrylonitrile butadiene styrene (ABS), polycarbonates, polyamides, and so forth. The latches 111 are mechanical fasteners capable of joining two (or more) surfaces while allowing for their separation. For example, the latches 111 can press against the walls of a wellbore with enough force such that the tool 100 is secured in place within the wellbore. As another example, the latches 111 can be paired with receivers inside a wellbore to secure the downhole tool 100 in place within the wellbore The electromagnetic source 130 is mechanically coupled to the support structure 110. The electromagnetic source 130 is operable to generate electromagnetic radiation. In the downhole tool 100, the electromagnetic source is at least partially enclosed within the support structure 110. The electromagnetic source 130 includes a magnetron. A magnetron is a vacuum tube capable of generating microwaves using the interaction of a stream of electrons with a magnetic field while moving past a series of open metal cavities known as cavity resonators. The frequency of the microwaves produced can be determined by the magnetron's physical dimensions. In some embodiments, the electromagnetic source 130 includes a klystron, which is a thermo-ionic electron tube that can generate microwaves and/or radio waves by controlling the speed of a stream of electrons into a cavity resonator. The electromagnetic source 130 can include other devices capable of generating microwave radiation such as, for example, traveling-wave tubes (TWT), gyrotrons, field-effect transistors, tunnel diodes, Gunn diodes, IMPATT diodes, and masers. In some embodiments, the electromagnetic source 130 includes an electronic oscillator capable of generating radio waves. In these embodiments, the electromagnetic source 130 can generate electromagnetic radiation having frequencies in the microwave range (300 gigahertz (GHz)-300 megahertz (MHz)) and/or frequencies in the radio range (300 GHz-3 kilohertz (kHz)). In some embodiments, the electromagnetic source 130 is not enclosed within the support structure 110.

The directional antenna 131 is communicatively coupled to the electromagnetic source 130. The directional antenna 131 has a length of about 5 centimeters (cm). In some embodiments, the directional antenna 131 has a length between 1 cm and 20 cm. However, in some embodiments, the directional antenna 131 is manufactured to be longer than 20 cm or shorter than 1 cm. The length can be based on design and practical considerations. For example, the size of the casing 120 can dictate the length of the antenna.

The directional antenna 131 is operable to transmit electromagnetic radiation in the microwave and/or radio wave frequencies. The directional antenna 131 is a rubber duck antenna. However, some tools 100 have other types of antennas. For example, in some embodiments, the directional antenna 131 is a sleeve dipole, a patch antenna, a whip antenna, or a printed circuit inverted F antenna (PIFA). In some embodiments, the directional antenna 131 is a directive antenna. For example, the directional antenna 131 can be a dish antenna, a horn antenna, a slot antenna, a dielectric lens antenna, and/or a flat microstrip antenna. The directional antenna 131 is a mechanically steerable beam antenna. A mechanically steerable antenna is an antenna that uses actuators and rotatable structures such as gimbals to change the physical orientation of the antenna and steer the output beam of the antenna. Additionally, or alternatively, the directional antenna 131 is an electronically steerable antenna, such as a phased array antenna or switched-beam array antenna. In some embodiments, the directional antenna 131 is an omnidirectional antenna.

The centralizer 140 is mechanically coupled to the support structure 110 and the casing 120. The centralizer 140 operates to maintain the downhole tool 100 in a central location with respect to the walls of the wellbore when the downhole tool 100 is located within the wellbore and advanced into the wellbore. In some embodiments, the centralizer 140 includes bowstrings, spring-loaded linkages, and/or floating spring mechanisms to maintain the downhole tool 100 in a centralized position within the wellbore. In some embodiments, the centralizer 140 includes an actuator to expand the centralizer from an unactuated position to an actuated position. In some embodiments, the centralizer 140 includes sensors to detect the orientation of the downhole tool 100 in the wellbore. In some embodiments, the centralizer 140 is actuated in response to the detected orientation of the downhole tool 100.

The casing 120 is cylindrical in shape and includes one or more ceramic materials. The casing 120 is sized to allow movement of the downhole tool 100 in a wellbore. The casing 120 is mechanically coupled to the support structure 110. The casing 120 is configured to be rotatable about the longitudinal axis of the support structure 110. However, in some embodiments, the casing 120 is fixed statically to the support structure 110. The casing 120 at least partially encloses the directional antenna 131. In some embodiments the casing 120 encloses more or less of the electromagnetic source 130 than the support structure 110. The casing 120 is completely made of one or more ceramic materials. However, as discussed later with reference to FIG. 2, in some tools, the casing 120 is only partially made of one or more ceramic materials. A ceramic material is a solid material comprising an inorganic compound of metal, non-metal, or metalloid atoms primarily held in ionic and/or covalent bonds. The ceramic materials can be one of several materials that can absorb electromagnetic radiation. In some embodiments, the ceramic materials include activated carbon. In some embodiments, the ceramic materials include clay. The clay can be hardened by heat.

The casing 120 is expandable. The casing 120 includes one or more hydraulic mechanisms, such as hydraulic pumps, that cause the casing 120 to expand. Additionally, or alternatively, the casing 120 includes one or more mechanical mechanisms, such as expansion shafts and/or expansion anchors, which cause the casing 120 to expand. Manufacturing the casing 120 to include expansion capabilities can allow for easier advancement of the downhole tool 100 through a wellbore, while allowing the casing 120 to directly contact the walls of the wellbore once the downhole tool 100 is in a desired position within the wellbore. For example, the downhole tool 100, including the casing 120, can be advanced downhole a wellbore with the casing 120 in a compressed position such that the casing 120 is not contacting the walls of the wellbore. This configuration can reduce the likelihood of causing an undesirable amount of friction (for example, an amount of friction that would cause damage to the wellbore and the casing 120, and/or an amount of friction that would make it difficult to advance the downhole tool 100 through the wellbore). Once the downhole tool 100 is located in a desired position within the wellbore, the expansion mechanisms of the casing 120 can be actuated to cause the casing 120 to contact the walls of the wellbore.

As indicated earlier, the directional antenna 131 can be operated to direct transmission of electromagnetic radiation. In embodiments where the casing 120 completely consist of ceramic materials, such as the embodiment shown in FIG. 1, the directional antenna 131 can be oriented (for example, by mechanically steering and/or electronically steering) to direct transmission of electromagnetic radiation towards desired areas of the hydrocarbon formation. The desired areas can absorb the electromagnetic radiation, causing the surrounding rock formations to increase in temperature at a rapid rate. The rapid increase in temperature can cause the surrounding rock formations to fracture, increasing the flow of oil into the wellbore. The increase in temperature can also lower the viscosity of oil within the surrounding rock formations to increase flow of oil into the wellbore.

The motor 150 is mechanically coupled to the casing 120. The motor 150 is operable to rotate the casing 120 about the longitudinal axis of the support structure 110. The motor 150 is positioned at a distal end of the casing 120 with respect to the electromagnetic source 130. However, in some embodiments, the motor 150 is positioned at other locations of the casing 120, such as the proximal end of the casing 120 with respect to the electromagnetic source 130. In some embodiments, the motor 150 is at least partially enclosed within the casing 120. However, in some embodiments, the motor 150 is completely external to the casing 120. Rotation of the casing 120 by the motor 150 can facilitate more control of the orientation of the heating zones 121.

The reinforced plug 160 includes steel. Additionally, or alternatively, the reinforced plug 160 can include other materials suitable for placement within a wellbore. In some embodiments, the reinforced plug 160 includes vulcanized rubber (such as Ebonite), super alloys, titanium, aluminum, acrylonitrile butadiene styrene (ABS), polycarbonates, polyamides, and so forth. The reinforced plug 160 is sized and shaped to be secured at an end of the casing 120. In some embodiments, the reinforced plug 160 is sized and shaped such that mechanical forces keep the reinforced plug 160 within the casing 120 and the reinforced plug 160 provides a sealing effect at an end of the casing 120. However, in some embodiments, the reinforced plug remains external to the casing 120 and is fixed to the end of the casing 120 by using, for example, one or more latching mechanisms. The reinforced plug can act to prevent damage to an end of the casing 120 and contain the electromagnetic radiation (and heat) within the casing 120.

Figure 2:
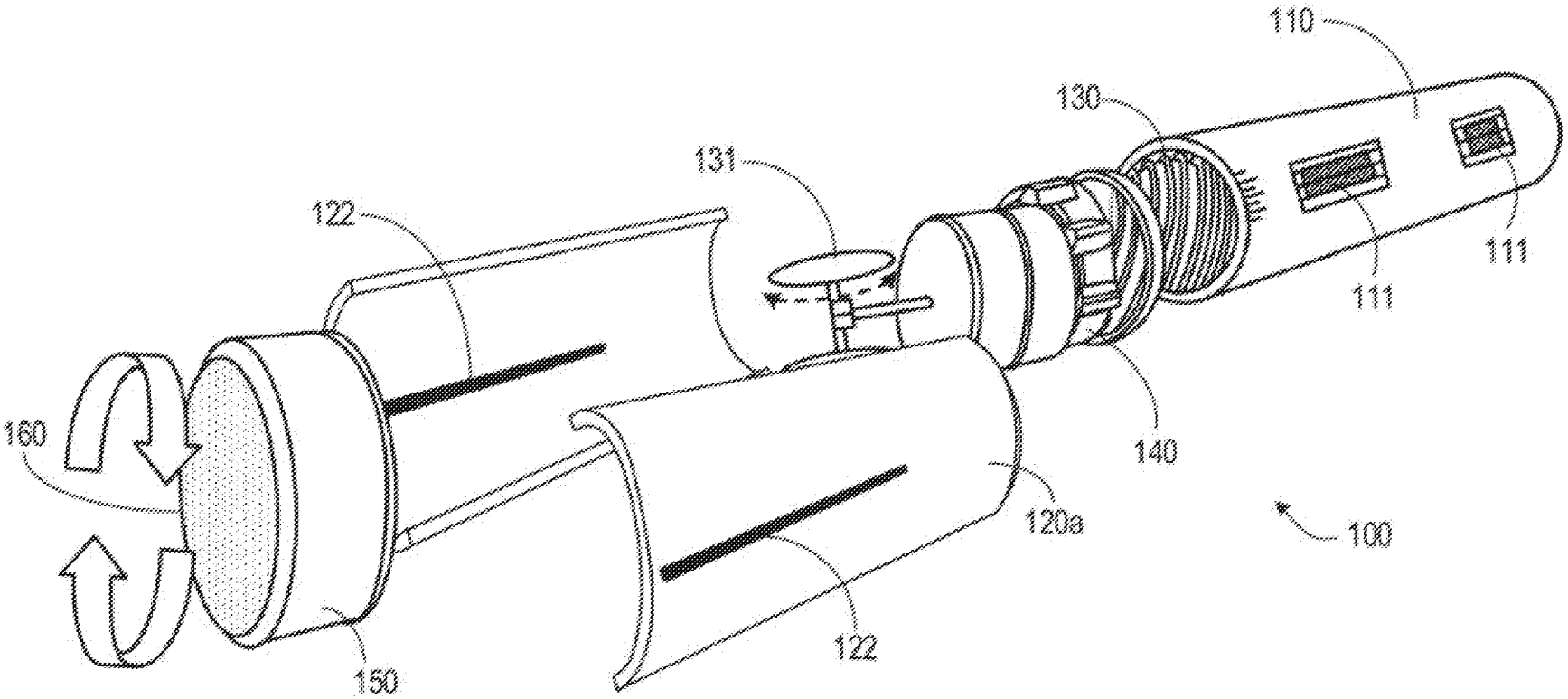
FIG. 2 is a partially exploded perspective view of a downhole tool having a rotatable antenna to direct electromagnetic waves.

FIG. 2 is an exploded perspective view of a downhole tool 100 having a casing **120*a* with one or more ceramic strips 122 for controlled fracture orientation and stimulation. The downhole tool 100 of FIG. 2 is substantially similar to the downhole tool 100 shown in FIG. 1. However, the casing 120*a* shown in FIG. 2 includes one or more ceramic strips 122** instead of being completely made of one or more ceramic materials.

The casing **120*a* is cylindrical in shape and is sized to allow movement of the downhole tool 100 in a wellbore. The casing 120*a* is mechanically coupled to the support structure 110. The casing 120*a* is configured to be rotatable about the longitudinal axis of the support structure 110. However, in some embodiments, the casing 120*a* is fixed statically to the support structure 110. The casing 120*a* at least partially encloses the antenna 131. In some embodiments, the casing 120*a* encloses at least a portion of the electromagnetic source 130. The casing 120*a* includes one or more ceramic strips 122. Each of the one or more ceramic strips 122 include one or more ceramic materials. The ceramic materials can be one of several materials that can absorb electromagnetic radiation. In some embodiments, the ceramic materials include activated carbon. In some embodiments, the ceramic materials include clay. The portions of the casing 120*a* other than the ceramic strips 122** include steel. Additionally, or alternatively, these portions include other materials suitable for wellbore operations such as, for example, vulcanized rubber (such as Ebonite), super alloys, titanium, aluminum, acrylonitrile butadiene styrene (ABS), polycarbonates, and polyamides.

The casing **120*a* is expandable. The casing 120*a* includes one or more hydraulic mechanisms, such as hydraulic pumps, that cause the casing 120*a* to expand. Additionally, or alternatively, the casing 120*a* includes one or more mechanical mechanisms, such as expansion shafts and/or expansion anchors, which cause the casing 120*a*** to expand.

Figure 3A:
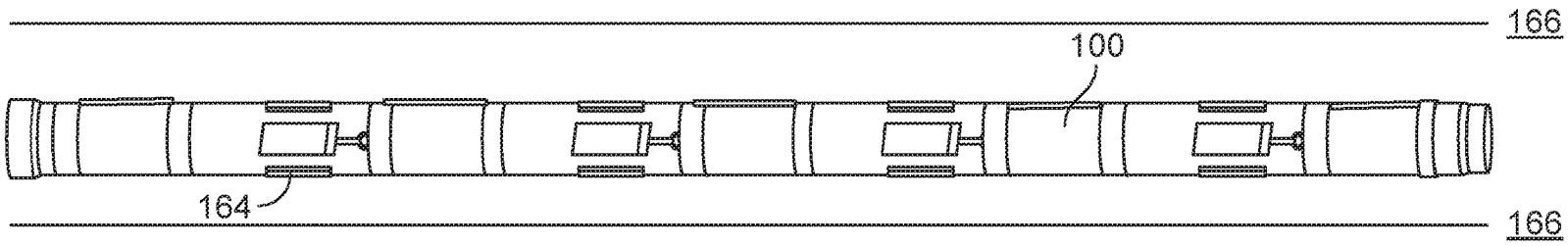
FIGS. 3A-C are views of a downhole tool having expandable packers to secure the tool within a hole.
Figure 3B:
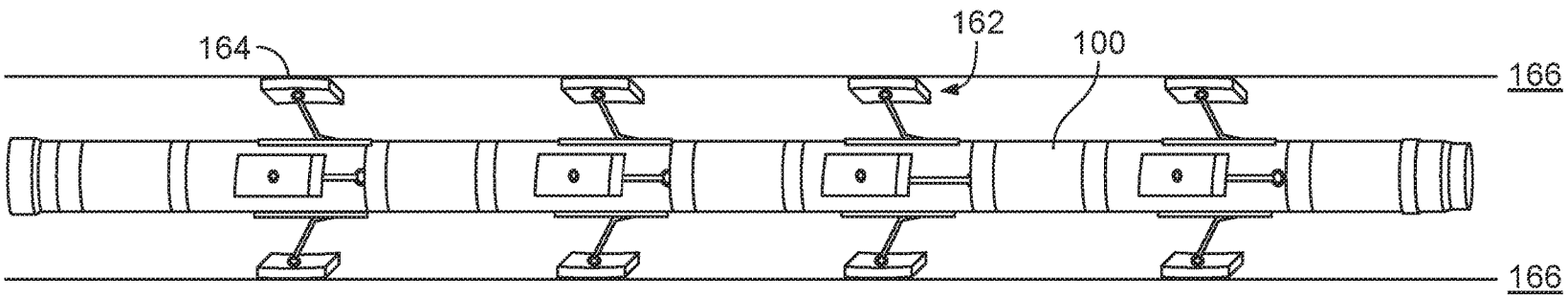
Figure 3C:
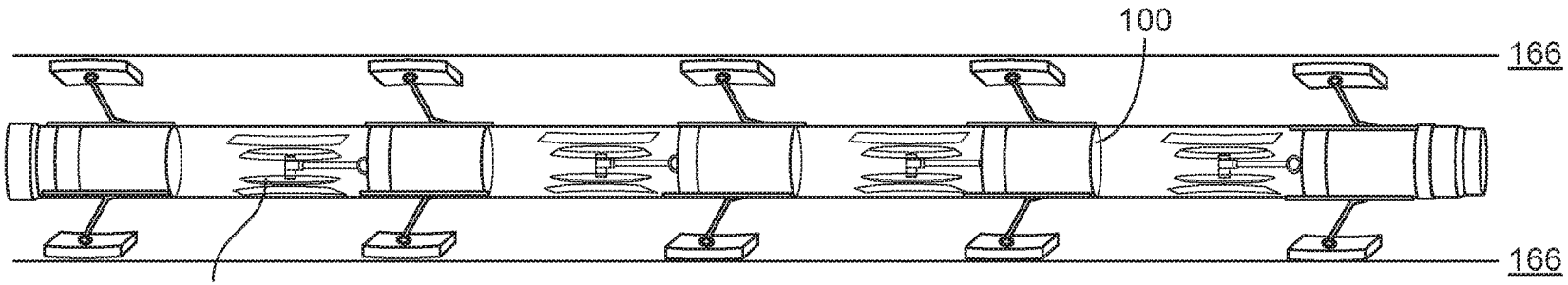

FIGS. 3A-C are views of a downhole tool 100 having expandable packers 162. The expandable packers 162 allow the tool 100 to be applied within an open hole, e.g., a hole that does not have a casing. The packers 162 are adjustable and flexible to contact edges that are irregular. The end face 164 of the packers 162 can also rotate to have adequate contact with irregular edges. The packers 162 can expand in an adjustable manner to stabilize and centralize the tool 100 within a hole. The packers 162 are illustrated in a contracted configuration in FIG. 3A and in an expanded configuration in FIG. 3B. The tool can be deployed within a hole in the contracted configuration, and then the packers 162 can expand into the expanded configuration until they contact the walls 166 of the hole to stabilize and centralize the tool 100 within the hole. FIG. 3C shows the directional antenna 131 within the downhole tool 100.

Figure 4:
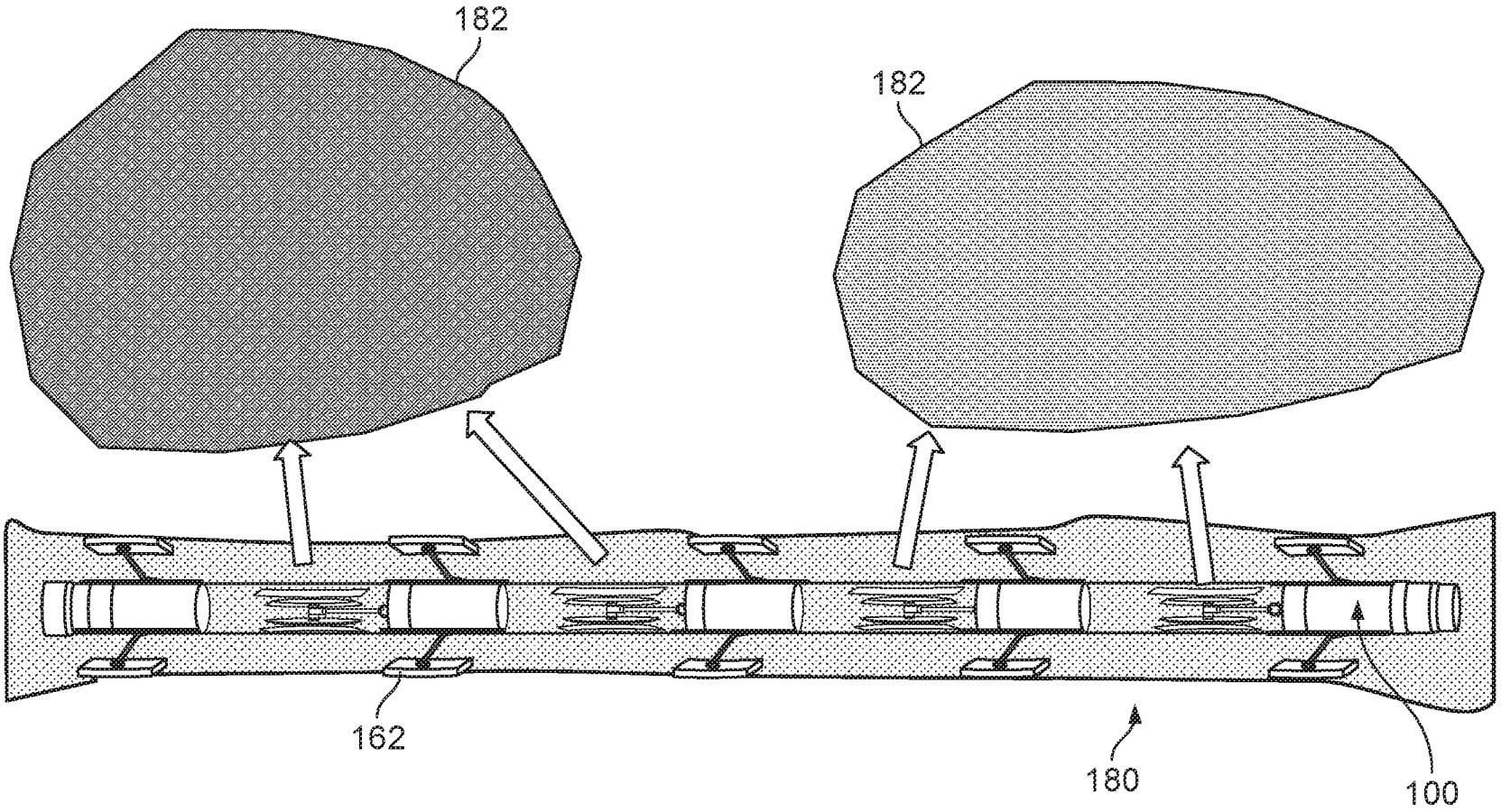
FIG. 4 is a view of a downhole tool deployed within a well.

FIG. 4 is a view of a downhole tool 100 deployed within a wellbore 180. The wellbore 180 is an open hole, e.g., a hole that does not have a casing. The edges of the wellbore 180 are irregular. The expandable packers 162 of the downhole tool 100 are expanded to stabilize and centralize the tool 100 within the wellbore 180. Once the tool 100 is in place, the fracture control system operates the electromagnetic source 130 such that the electromagnetic source 130 generates electromagnetic radiation. As previously discussed with reference to FIG. 1, the directional antenna 131 is capable of transmitting the electromagnetic radiation generated by the electromagnetic source 130. The fracture control system operates the directional antenna 131 to steer the direction of the transmitted electromagnetic radiation to a desired location. For example, the transmitted electromagnetic radiation can be steered towards a target zone 182. For example, the target zones can be within a few feet of each other. In response to receiving the electromagnetic radiation, the temperature of the target zones 182 increases allowing oil within the subterranean formation to flow more freely.

Figure 5:
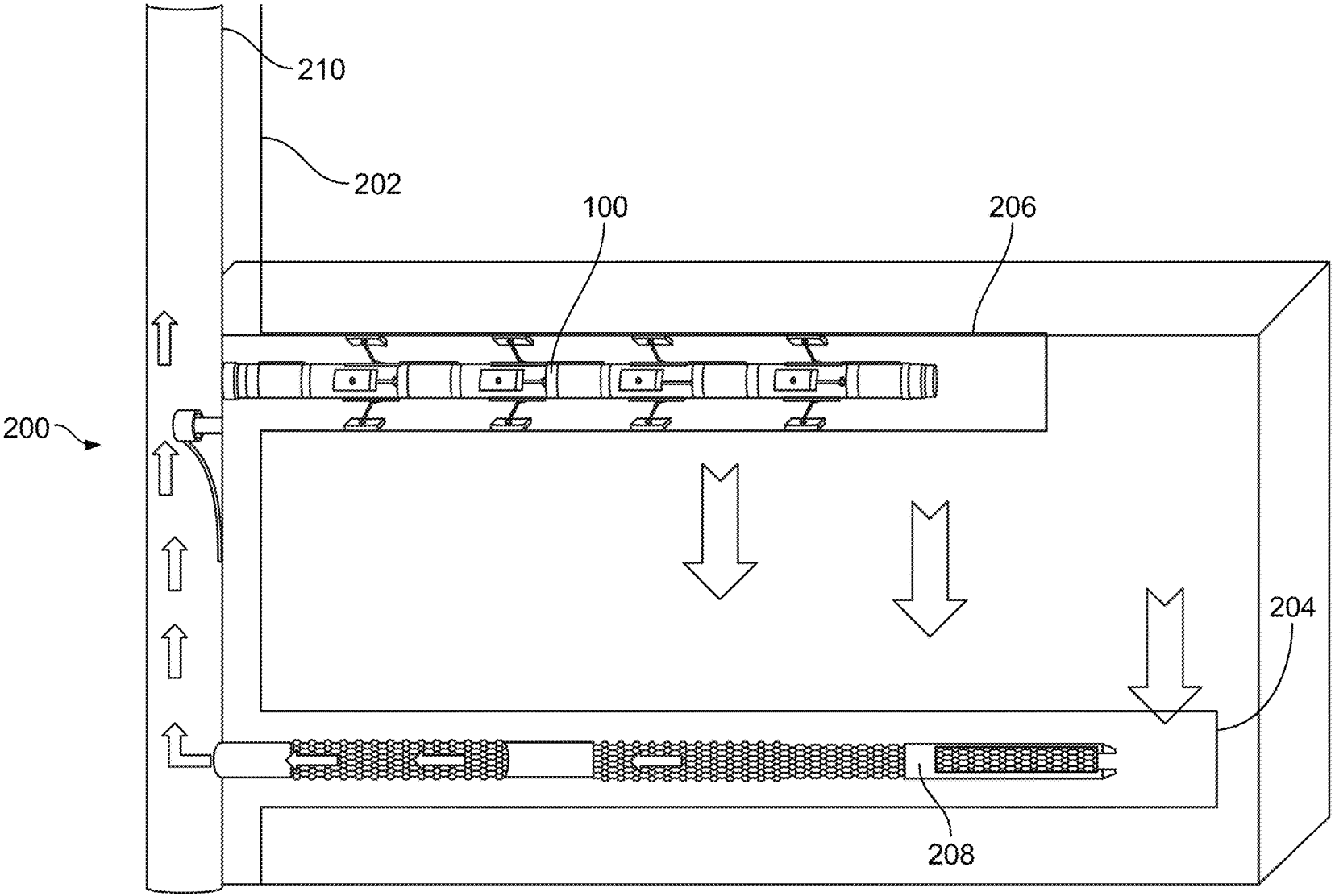
FIG. 5 is a view of a dual well for fracture stimulating and producing hydrocarbons.

FIG. 5 is a view of a dual well for fracture stimulating and producing hydrocarbons. The dual well includes tubing 200 which can bring oil, natural gas, petroleum, etc. to the surface. The tubing 200 is placed within a main wellbore 202, which extends from the surface into the hydrocarbon formation. A first lateral 204 and a second lateral 206 extend laterally from the main wellbore 202. A downhole tool 100 is positioned within the second lateral 206 and connected to the tubing 200. At least some of the hardware required for the downhole tool 100 (e.g., a power source, wiring, sensors, thermometers) can be positioned within the tubing. The downhole tool 100 can transmit electromagnetic radiation to stimulate oil flow and increase oil flow within a subterranean formation, as discussed above. A producer 208 positioned within the first lateral 204 and connected to the tubing 200 such that hydrocarbons produced by the producer 208 are directed from the subsurface formation to a ground surface through the main wellbore. A divider 210 is positioned within the tubing 200 to isolate the hardware of the downhole tool 100 from hydrocarbons flowing towards the ground surface. When the downhole tool 100 stimulates oil flow within the formation, the producer 208 can produce (e.g., collect) the oil and direct the oil towards the ground surface. This dual well can reduce the footprint necessary for producing oil because the downhole tool 100 and the producer 208 can be connected to the same tubing and positioned within the same main wellbore.

Figure 6:
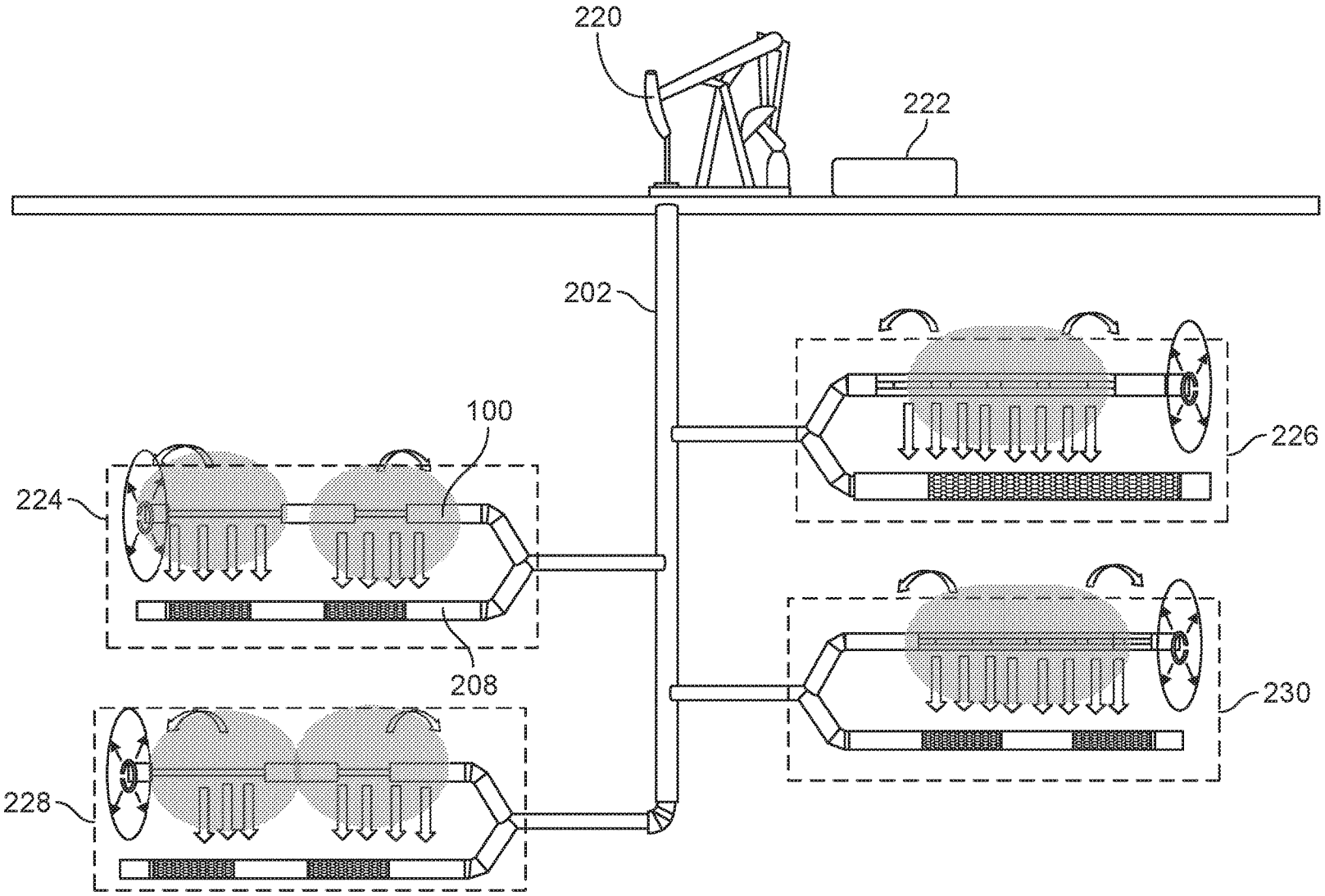
FIG. 6 is a view of a dual well in use.

FIG. 6 is a view of a dual well system in use. A pump 220 is positioned on the surface and pulls flowing hydrocarbons towards the surface through the tubing 202. An electromagnetic source 222 can also be positioned on the surface and can contain hardware, e.g., power sources, for downhole tools 100. A downhole tool 100 and a producer 208 extend laterally from the tubing 202 and can be used to produce hydrocarbons, as discussed above. In some implementations, the downhole tool can be assembled on the surface and then inserted into the well. In some implementations, the downhole tool 100 and producer 208 can be moved into several positions surrounding the tubing 200. For example, the downhole tool 100 and producer 208 can be positioned in a first position 224 for a desired amount of time, e.g., to produce a certain amount of hydrocarbons. The downhole tool 100 and producer 208 can then be moved into a second position 226 for a desired amount of time. The downhole tool 100 and producer 208 can continue to be moved into a third position 228 and then a fourth position 230. In some implementations, the downhole tool 100 and producer 208 can be moved to more or fewer positions to produce oil in desired locations around the tubing 202 and pump 220. In some implementations, multiple downhole tools 100 and producers 208 can be positioned around the tubing 202 and pump 220 at the same time. For example, there can be a downhole tool 100 and a producer 208 in each of the described positions 224, 226, 228, 230 simultaneously.

Figure 7:
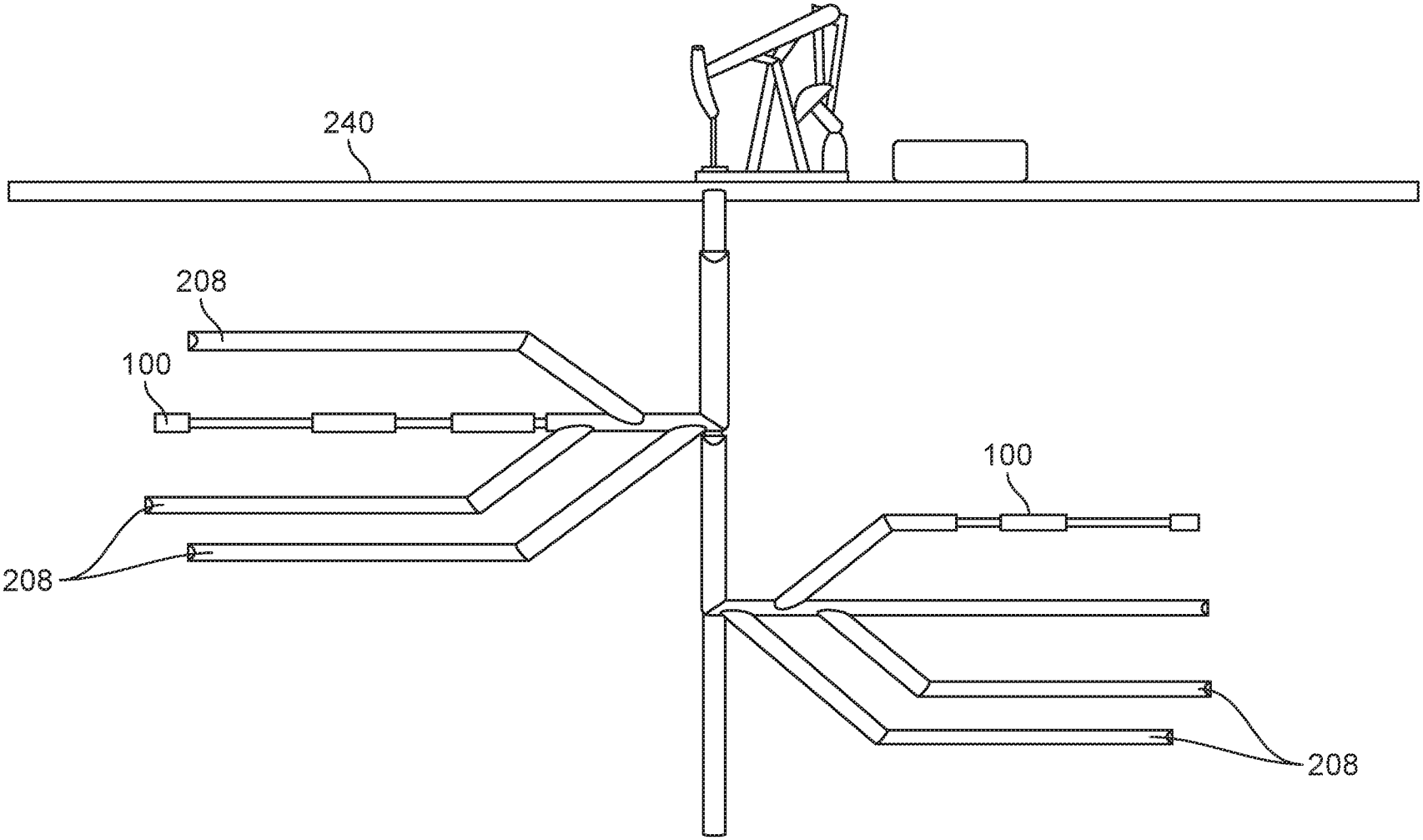
FIG. 7 is a view of a different dual well for fracture stimulating and producing hydrocarbons.

FIG. 7 is a view of a different dual well system for fracture stimulating and producing hydrocarbons. The system includes multiple producers 208 positioned around a downhole tool 100. The producers 208 can be positioned closer to the ground surface 240 than the downhole tool 100, or the producers 208 can be positioned farther from the ground surface 240 than the downhole tool 100. For example, the laterals which contain the producers 208 can be closer to or farther from the ground surface 240 than the downhole tool 100. In some implementations, more or fewer producers 208 can be positioned around the downhole tool 100.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Accordingly, the previously described example implementations do not define or constrain the present disclosure. Other changes, substitutions, and alterations are also possible without departing from the spirit and scope of the present disclosure.

What is claimed is:

1. A method for transmitting electromagnetic radiation within a wellbore in a hydrocarbon formation, the method comprising:

providing a tool comprising:

a support structure with a longitudinal axis and having a cylindrical shape, the support structure comprising one or more latching mechanisms;

expandable packers mechanically coupled to the support structure, the expandable packers being radially expandable to secure the tool within a lateral of the wellbore;

an electromagnetic source mechanically coupled to the support structure and operable to generate electromagnetic radiation; and an antenna communicatively coupled to the electromagnetic source and operable to transmit the electromagnetic radiation to a target zone of the subsurface formation, the target zone being separate from the downhole tool, the antenna being at least partially disposed within the casing and rotatable to steer the electromagnetic radiation;

deploying the tool in the wellbore;

operating the electromagnetic source to generate the electromagnetic radiation; and heating desired areas of the hydrocarbon formation by steering the antenna to direct transmission of the electromagnetic radiation to the desired areas of the hydrocarbon formation such that the desired areas of the hydrocarbon formation absorb the electromagnetic radiation causing the surrounding rock formations to increase in temperature.

2. The method of claim 1, wherein the electromagnetic source generates electromagnetic radiation having frequencies in the microwave region of the electromagnetic spectrum.

3. The method of claim 1, wherein the antenna is mechanically rotatable about the longitudinal axis of the support structure.

4. The method of claim 1, wherein the antenna is capable of electronically steering the electromagnetic radiation.

* * * * *